US008277009B2

(12) United States Patent
Kobayashi

(10) Patent No.: US 8,277,009 B2
(45) Date of Patent: Oct. 2, 2012

(54) IMAGE RECORDING DEVICE

(75) Inventor: Isao Kobayashi, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 445 days.

(21) Appl. No.: 12/610,681

(22) Filed: Nov. 2, 2009

(65) Prior Publication Data

US 2010/0110116 A1 May 6, 2010

(30) Foreign Application Priority Data

Oct. 31, 2008 (JP) ..... 2008-280824

(51) Int. Cl.
*B41J 29/38* (2006.01)

(52) U.S. Cl. ..... 347/14; 347/12

(58) Field of Classification Search ..... None
See application file for complete search history.

(56) References Cited

U.S. PATENT DOCUMENTS

| | | | |
|---|---|---|---|
| 6,170,932 | B1 | 1/2001 | Kanaya et al. |
| 2008/0152413 | A1 | 6/2008 | Yoshida et al. |

FOREIGN PATENT DOCUMENTS

| | | |
|---|---|---|
| JP | 11-28807 | 2/1999 |
| JP | 11-34397 | 2/1999 |
| JP | 2002-337324 | 11/2002 |
| JP | 2008-155376 | 7/2008 |

OTHER PUBLICATIONS

Japanese Official Action dated Aug. 3, 2010.

*Primary Examiner* — Jerry Rahll
(74) *Attorney, Agent, or Firm* — Scully, Scott, Murphy & Presser, P.C.

(57) ABSTRACT

An image recording device including a feeder and a recorder with dot forming elements aligned in a predetermined direction at intervals of a predetermined pitch. When determining that a first whole length of an image group to be printed in the predetermined direction is more than a second whole length of the dot forming elements in the predetermined direction, the image recording device records the image group with the recorder while feeding a recording medium with the feeder by a first feed distance more than the predetermined pitch each printing operation to be repeated. When determining that the first whole length is equal to or less than the second whole length, the image recording device records the image group with the recorder while feeding the recording medium with the feeder by a second feed distance equal to or less than the predetermined pitch each printing operation to be repeated.

9 Claims, 6 Drawing Sheets

IMAGE RECORDING DEVICE

CROSS-REFERENCE TO RELATED APPLICATIONS

This application claims priority under 35 U.S.C. §119 from Japanese Patent Application No. 2008-280824 filed on Oct. 31, 2008. The entire subject matter of the application is incorporated herein by reference.

BACKGROUND

1. Technical Field

The following description relates to one or more image recording devices.

2. Related Art

So far, an inkjet printer has been known as an example of an image recording device that records an image on a recording medium. The inkjet printer is configured to record an image on a recording medium by repeating main scanning and auxiliary scanning. In the main scanning, a recording head, which has a plurality of nozzles aligned at intervals of a predetermined distance (pitch) in an auxiliary scanning direction, is reciprocated relative to the recording medium along a main scanning direction, while the nozzles discharges ink onto the recording medium. In the auxiliary scanning, the recording medium moves relative to the recording head in a single direction (i.e., the auxiliary scanning direction). An interlaced recording method has been known as an example of the aforementioned recording method.

In a known interlaced recording method, a lot of main scanning lines of the same color are concurrently recorded in a single scanning operation in a main scanning direction with a recording head which has multiple inkjet nozzles aligned in an auxiliary scanning direction on a head surface thereof. Further, in the known interlaced recording method, any two adjacent lines are recorded with different inkjet nozzles in different scanning operations, respectively. Thereby, it is allegedly possible to obscure variations in the characteristics and the pitches of the inkjet nozzles and attain high-quality recording.

SUMMARY

In the above interlaced recording method, as mentioned above, any two adjacent lines in the auxiliary scanning direction are recorded with different inkjet nozzles in different scanning operations, respectively. In the case of recording such a predetermined image that the whole length thereof in the auxiliary scanning direction is equal to or less than the whole length of the inkjet nozzles aligned on the recording head in the auxiliary scanning direction, an increased number of main scanning operations is required. Thus, it unfortunately results in decreased throughput for recording the aforementioned predetermined image.

Aspects of the present invention are advantageous to provide one or more improved image recording devices that make it possible to decrease the number of main scanning operations and enhance the throughput for recording the aforementioned predetermined image.

According to aspects of the present invention, an image recording device is provided, which includes a feeder configured to feed a recording medium in a predetermined direction, a recorder comprising a plurality of dot forming elements aligned in the predetermined direction at intervals of a predetermined pitch, the recorder being configured to record images by forming dots, with the dot forming elements, at intervals of a distance shorter than the predetermined pitch in the predetermined direction on the recording medium fed by the feeder, a first identifying unit configured to identify, as an image group, at least one image to be recorded between blank areas in the predetermined direction, a determining unit configured to determine whether a first whole length of the image group identified by the first identifying unit in the predetermined direction is equal to or less than a second whole length of the dot forming elements in the predetermined direction, a first controller configured to, when the determining unit determines that the first whole length is not equal to or less than the second whole length, repeat a first feed control and a first record control so as to record the image group, the first controller controlling, in the first feed control, the feeder to feed the recording medium by a first feed distance more than the predetermined pitch, the first controller controlling, in the first record control, the recorder to record a part of the image group with dot forming elements selected such that any adjacent two dots of the image group in the predetermined direction are recorded with respective different dot forming elements, and a second controller configured to, when the determining unit determines that the first whole length is equal to or less than the second whole length, repeat a second feed control and a second record control so as to record the image group, the second controller controlling, in the second feed control, the feeder to feed the recording medium by a second feed distance equal to or less than the predetermined pitch, the second controller controlling, in the second record control, the recorder to record a part of the image group such that any adjacent two dots of the image group in the predetermined direction are permitted to be recorded with an identical dot forming element.

According to aspects of the present invention, further provided is an image recording device which includes a feeder configured to feed a recording medium in a predetermined direction, a recorder comprising a plurality of dot forming elements aligned in the predetermined direction at intervals of a predetermined pitch, the recorder being configured to record images by forming dots, with the dot forming elements, at intervals of a distance shorter than the predetermined pitch in the predetermined direction on the recording medium fed by the feeder, a first identifying unit configured to identify, as an image group, at least one image to be recorded between blank areas in the predetermined direction, a determining unit configured to determine whether a sum of a first whole length of the image group identified by the first identifying unit in the predetermined direction and a second whole length of a downstream one of the blank areas in the predetermined direction is equal to or less than a third whole length of the dot forming elements in the predetermined direction, a first controller configured to, when the determining unit determines that the sum of the first whole length and the second whole length is not equal to or less than the third whole length, repeat a first feed control and a first record control so as to record the image group, the first controller controlling, in the first feed control, the feeder to feed the recording medium by a first feed distance more than the predetermined pitch, the first controller controlling, in the first record control, the recorder to record a part of the image group with dot forming elements selected such that any adjacent two dots of the image group in the predetermined direction are recorded with respective different dot forming elements, and a second controller configured to, when the determining unit determines that the sum of the first whole length and the second whole length is equal to or less than the third whole length, repeat a second feed control and a second record control so as to record the image group, the second controller controlling, in the second feed control, the feeder to feed the recording medium by a second feed distance equal to or less than the predetermined pitch, the second controller controlling, in the second record control, the recorder to record a part of the image group such that any adjacent two dots of the image group in the predetermined direction are permitted to be recorded with an identical dot forming element.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an embodiments according to aspects of the present invention will be described with reference to the accompany drawings. A Multi-Function Peripheral (MFP) 10, shown as an example of an image recording device in FIG. 1, has a printer function, a scanner function, and a copy function.

In order to reduce the number of main scanning operations for recording the predetermined image and enhance throughput in the recording, the MFP 10 is configured to print an image on a sheet using a selected one of two different kinds of interlace methods depending on the image width in an auxiliary scanning direction. Although a detailed explanation of it will be given later, one of the two kinds of interlace methods is adapted to print an image while conveying a sheet by a feed distance d2 each feeding (hereinafter referred to as an "even feed method"), and the other is adapted to print an image while conveying a sheet by a feed distance d1, less than the feed distance d2, each feeding (hereinafter referred to as a "fine feed method").

Figure 2A:
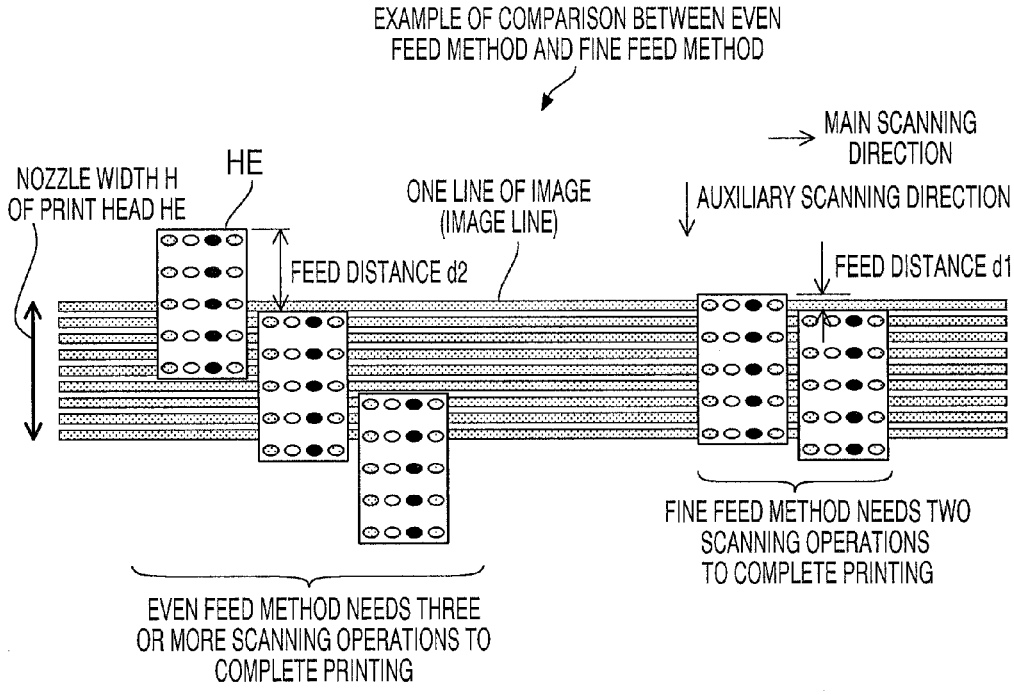
FIG. 2A is an illustration for making an operational comparison between an even feed method and a fine feed method in the embodiment according to one or more aspects of the present invention.

The MFP 10 of the embodiment selects the even feed method when a group of images to be printed has a vertical width (in the auxiliary scanning direction) longer than a nozzle width H of a print head HE (see FIG. 2A). Meanwhile, the MFP 10 selects the fine feed method when the image group to be printed has a width in the auxiliary scanning direction equal to or less than the nozzle width H of the print head HE.

The MFP 10 includes a printer unit 11 disposed at a lower side thereof, a scanner unit 12 disposed at an upper side, and an operation panel 92 disposed at an upper front side. The printer unit 11 is configured with an inkjet printer to perform color printing using four colors of ink, i.e., cyan (C), magenta (M), yellow (Y), and black (K).

Figure 1:
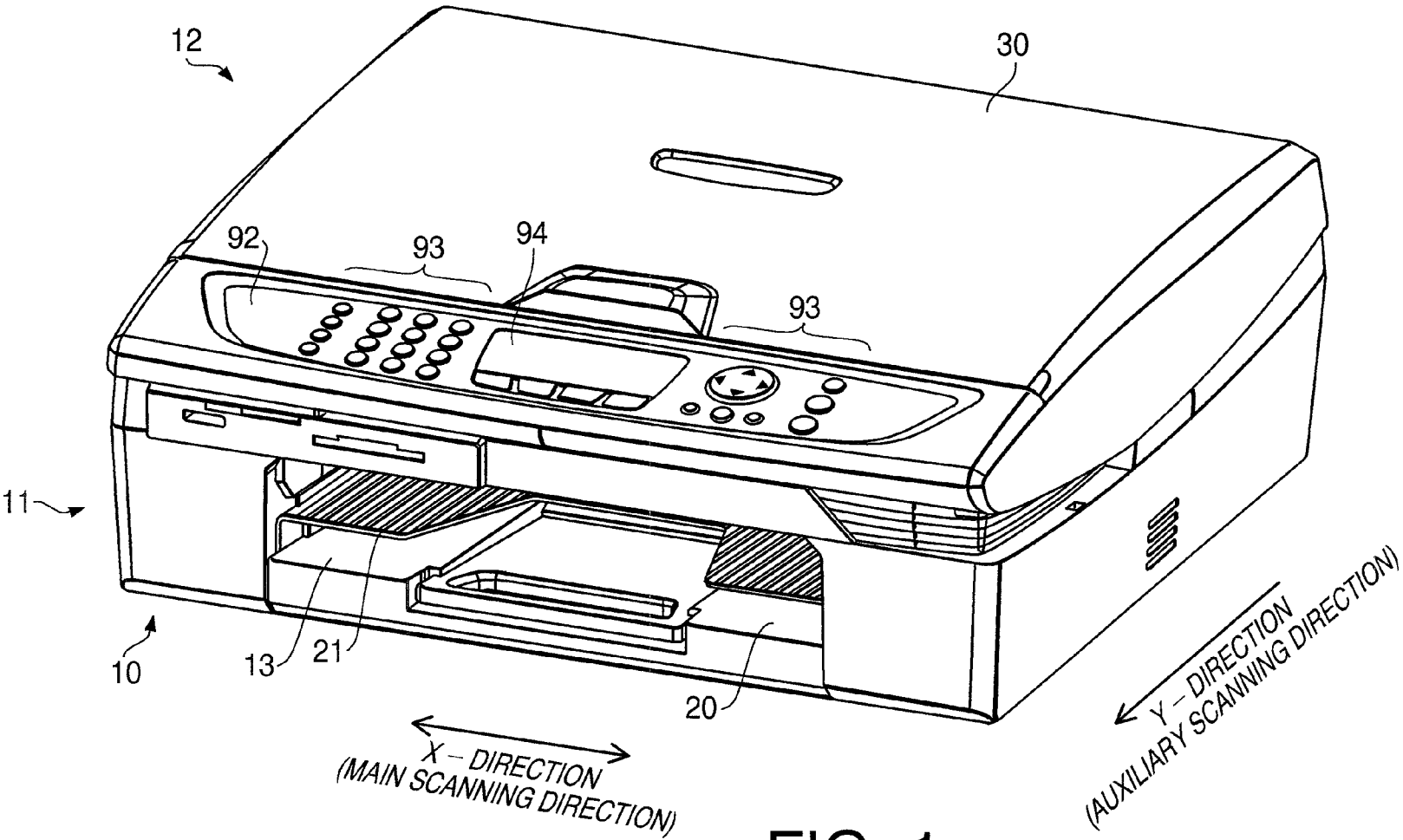
FIG. 1 is an external perspective view of a Multi-Function Peripheral (MFP) in a embodiment according to one or more aspects of the present invention.

The printer unit 11 includes a feed motor 11*a* (see FIG. 2B) to feed a sheet, the print head HE (see FIG. 2A) to discharge ink onto the sheet, a carriage (not shown) loaded with the print head HE, and a carriage motor (not shown) to reciprocate the carriage in a main scanning direction (an X-direction in FIG. 1).

When an image is printed on a sheet, initially the sheet is fed from a feed tray 20. The fed sheet is conveyed toward the back of an opening 13, turned around from a lower side to an upper side, and guided to the carriage. Then, the sheet is fed to an initial print start position of the image in the auxiliary scanning direction (a Y-direction in FIG. 1). Further, the carriage is moved to the initial print start position of the image in the main scanning direction (the X-direction in FIG. 1). After that, the carriage is moved in the main scanning direction while the print head HE is discharging ink, and thereby an image is printed on the sheet in the main scanning direction.

Then, after the printing of the image in the main scanning direction, the sheet is fed by a predetermined distance in the auxiliary scanning direction (the Y-direction in FIG. 1). Further, the carriage is moved to a next print start position to begin printing in the main scanning direction. After that, in the same manner, the desired image is completely printed by repeatedly feeding the sheet in the auxiliary scanning direction, moving the carriage to a subsequent print start position, and printing an image in the main scanning direction. Finally, the sheet with the image printed thereon is ejected onto a catch tray 21.

As described before, the printer unit 11 is configured to perform a printing operation using a selected one of the two kinds of interlace methods, i.e., the even feed method and the fine feed method, depending on the image width in the auxiliary scanning direction. Hereinafter, referring to FIG. 2A, an explanation will be given about the even feed method and the fine feed method.

Firstly, the print head HE of the printer unit 11 will be described. As illustrated in FIG. 2A, the print head HE has (a set of) four nozzles aligned in the main scanning direction that discharge four color of ink, respectively. Further, multiple sets of four nozzles are arranged in the auxiliary scanning direction at intervals of a predetermined pitch. It is noted that each set of four nozzles provided to the print head HE has a nozzle number (1, 2, 3, . . . ) attached thereto in the order from an upper end to a lower end of the print head HE in the auxiliary scanning direction.

When the print head HE is moved in the main scanning direction while any one of the multiple sets of nozzles, arranged in the auxiliary scanning direction, is discharging ink, a line of image is printed in the main scanning direction. For example, the print head HE shown in FIG. 2A has five sets, of four nozzles, which are arranged in the auxiliary scanning direction at intervals of a single line pitch. Therefore, in a single scanning operation to scan the print head HE in the main scanning direction, up to five lines of images can be printed on a sheet.

A whole image (image data) to printed on a sheet is configured with at least one line of image. Each line of the whole image is either a line with ink at least partially discharged thereon (hereinafter referred to as an "image line") or a line with no ink discharged thereon (hereinafter referred to as a "blank line"). Further, each line constituting the whole image has a line number (1, 2, 3, . . . ) attached thereto in the order from an upper (upstream) end to a lower (downstream) end of the whole image in the auxiliary scanning direction.

Subsequently, an explanation will be given about the even feed method and the fine feed method. As mentioned above, in the even feed method, the print head HE is scanned in the main scanning direction while a sheet is being fed by the feed distance d2 each feeding, such that an image is printed on the sheet.

For example, the feed distance d2 is determined based on an image resolution R [lines/inch] in the auxiliary scanning direction, a nozzle width H [inches] of the print head HE in the auxiliary scanning direction, a nozzle density [lines/inch] of the print head HE, and a maximum image resolution MR [lines/inch] representing the maximum number of printable lines per a unit length in the auxiliary scanning direction. However, in this respect, the image resolution R is equal to or less than the maximum image resolution MR. Specifically, the feed distance d2 is determined as follows:

$$d2\ [\text{inches}]=(H\ [\text{inches}]\times MR\ [\text{lines/inch}]/K)\times(\text{a line of feed distance [inches]}),$$

where "K" is a "repeat number" that represents how many times an identical area is repeatedly scanned in a printing operation, and expressed as follows:

$$K\ [\text{times}]=R\ [\text{lines/inch}]/D\ [\text{lines/inch}].$$

It is noted that the above feed distance d2 is just an example, and may be set appropriately depending on the specification of the printer unit 11.

For instance, when an image of 300 [dpi] is printed with the print head HE with a nozzle density D of 150 [lines/inch], the repeat number K is two [times]. In other words, an image of 150 [lines/inch] is printed repeatedly (two times) on an identical area to obtain a printed image of 300 [dpi].

Furthermore, in the even feed method, when an image is repeatedly printed on an identical area, the image is printed with nozzles appropriately selected such that a nozzle once used is not repeatedly used in the same area. For example, in the same area, initially, images corresponding to odd line numbers are printed with nozzles corresponding to odd nozzle numbers, and subsequently, images corresponding to even line numbers are printed with nozzles corresponding to even nozzle numbers.

According to the aforementioned printing manner, even though there is variation in the pitches or the ink discharging characteristics of the nozzles of the print head HE, it is possible to disperse printed areas deteriorated due to the variation and obscure the deteriorated image quality. Thereby, it is possible to avoid a locally deteriorated image and thus obtain a uniformed and enhanced quality of whole image.

For example, when nine lines of images (i.e., nine image lines) are printed with the print head HE as shown in FIG. 2A, since the images are printed while the sheet is being fed by the feed distance d2 each feeding, at least three scanning operations are needed.

On the other hand, in the fine feed method, the print head HE is scanned in the main scanning direction while a sheet is being fed by the feed distance d1, shorter than the feed distance d2, each feeding, such that an image is printed on the sheet. For example, the feed distance d1 is determined as follows:

$$d1\ [\text{inches}]=(MR\ [\text{lines/inch}]/R\ [\text{lines/inch}])\times(\text{a line of feed distance [inches]}).$$

It is noted that the above feed distance d1 is just an example, and may be set appropriately depending on the specification of the printer unit 11.

For example, when nine lines of images (i.e., nine image lines) are printed with the print head HE as shown in FIG. 2A, since the images are printed while the sheet is being fed by the feed distance d1 (i.e., a line of distance) each feeding, the images are completely printed by two scanning operations. Namely, the fine feed method makes it possible to render the number of scanning operations less than the even feed method, and to enhance the throughput for printing the nine lines of images.

Since the fine feed method employs the feed distance d1 shorter than the feed distance d2, when there is variation in the pitches or the ink discharging characteristics of the nozzles of the print head HE, it is hard to disperse printed areas of image quality deteriorated due to the variation. Nonetheless, the fine feed method is employed only when a group of images to be printed has a vertical width (in the auxiliary scanning direction) shorter than the nozzle width H of the print head HE, i.e., when the printing operation is performed within a limited narrow area. Therefore, even when the image quality is deteriorated due to the variation, there are a small number of images to be compared around the group of the printed images. Hence, even though the image quality is locally deteriorated, it is hard to visually recognize it. Thus, it is possible to maintain the quality of the image as a whole.

Referring back to FIG. 1, an explanation will be given again as to the configuration of the MFP 10. The opening 13 is formed at a front face of the printer unit 11. The feed tray 20 and the catch tray 21 are arranged in the vertical direction such that they are partially exposed to the outside of the printer unit 11 through the opening 13. The feed tray 20 is configured to be loaded with sheets to be printed. A sheet loaded on the feed tray 20 is fed into the printer unit 11, and ejected onto the catch tray 21 with a desired image printed thereon.

The scanner unit 12 is configured as a flatbed scanner. A document cover 30 is provided as a top cover of the MFP 10. A platen glass (not shown) is disposed under the document cover 30. A document sheet is placed on the platen glass, and read with the scanner unit 12 in a state covered with the document cover 30.

The operation panel 92 is for operating the printer unit 11 and the scanner unit 12. The operation panel 92 includes operation keys 93 and an LCD 94. A user can configure settings of various functions of the MFP 10 and utilize the functions by operating the operations keys 93. For example, the user can issue, through the operation panel 92, an instruction to set a sheet type (a regular sheet or a postcard) or resolution (a draft mode or photo mode).

Figure 2B:
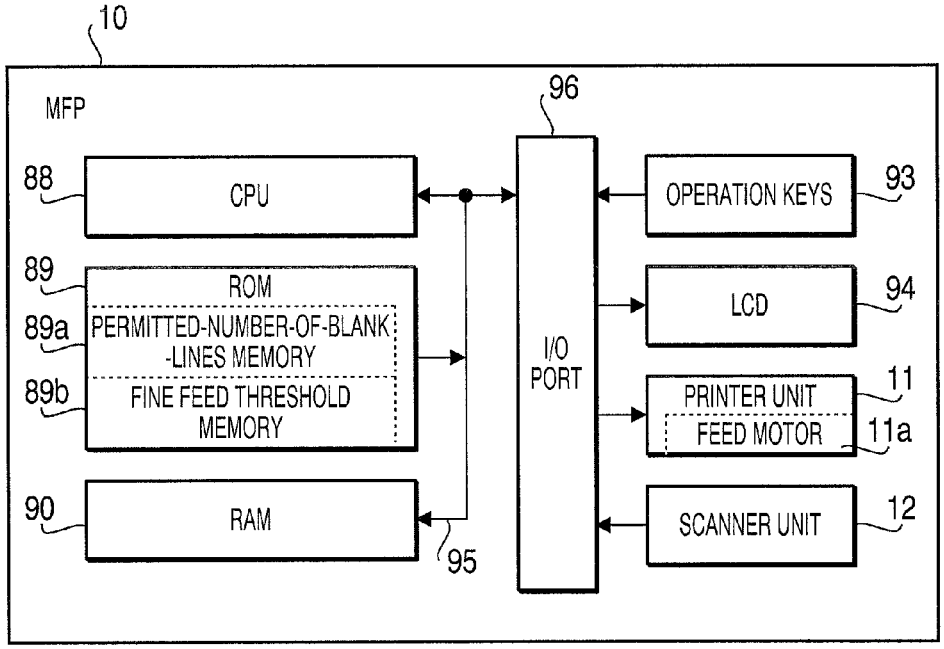
FIG. 2B is a block diagram schematically showing an electrical configuration of the MFP in the embodiment according to one or more aspects of the present invention.

Subsequently, an electrical configuration of the MFP 10 will be described with reference to FIG. 2B. As illustrated in FIG. 2B, the MFP 10 includes a CPU 88, a ROM 89, a RAM 90, the operation keys 93, the LCD 94, the printer unit 11, and the scanner unit 12.

The CPU 88, the ROM 89, and the PAM 90 are interconnected via a bus line 95. In addition, the operation keys 93, the LCD 94, the printer unit 11, the scanner unit 12, and the bus line 95 are interconnected via an input/output (I/O) port.

The CPU 88 is configured to take control of various functions of the MFP 10 and each element connected with the I/O port 96 in accordance with fixed values and programs stored on the ROM 89 and the RAM 90. The ROM 89 is a non-rewritable memory that stores thereon control programs to be executed by the MFP 10. The ROM 89 stores thereon below-mentioned processes such as an interlaced printing process shown in a flowchart of FIG. 3, a fine feed printing process shown in a flowchart of FIG. 4A, and an even feed printing process shown in a flowchart of FIG. 4B.

Further, the ROM 89 includes a permitted-number-of-blank-lines memory 89*a* and a fine feed threshold memory 89*b*. The permitted-number-of-blank-lines memory 89*a* is configured to store the number of blank lines as a condition for dividing a whole image based on image data into a plurality of image groups.

Although detailed an explanation of it will be given later, for example, when the number of lines "3" is stored on the permitted-number-of-blank-lines memory 89*a*, an image is sectioned with four or more (i.e., more than three) successive blank lines in a direction from an initial line to a final line as a separator. Further, images (lines) in each sectioned area are defined as an image group.

In other words, when the number of continuously emerging blank lines is equal to or less than the value stored on the permitted-number-of-blank-lines memory 89*a*, the blank lines are recognized as a part of a continuing image group.

The fine feed threshold memory 89*b* is configured to store the number of lines that is a criterion for determination as to which is to be used for printing an image group to be printed, between the fine feed method and the even feed method. Specifically, the fine feed threshold memory 89*b* stores a value calculated according to the expression "the nozzle width H [inches]×the maximum image resolution MR [lines/inch]."

When the total number of lines included in an image group to be printed is equal to or less than the value stored on the fine feed threshold memory 89*b*, the image group to be printed is printed in the fine feed method. Meanwhile, when the total number of lines included in an image group to be printed is more than the value stored on the fine feed threshold memory 89*b*, the image group to be printed is printed in the even feed method.

The RAM 90 is a rewritable memory configured to temporarily store various data in execution of each operation by the MFP 10. For instance, when a print request for printing of an image is issued, the RAM 90 temporarily stores image data of the image to be printed based on the print request.

Figure 3:
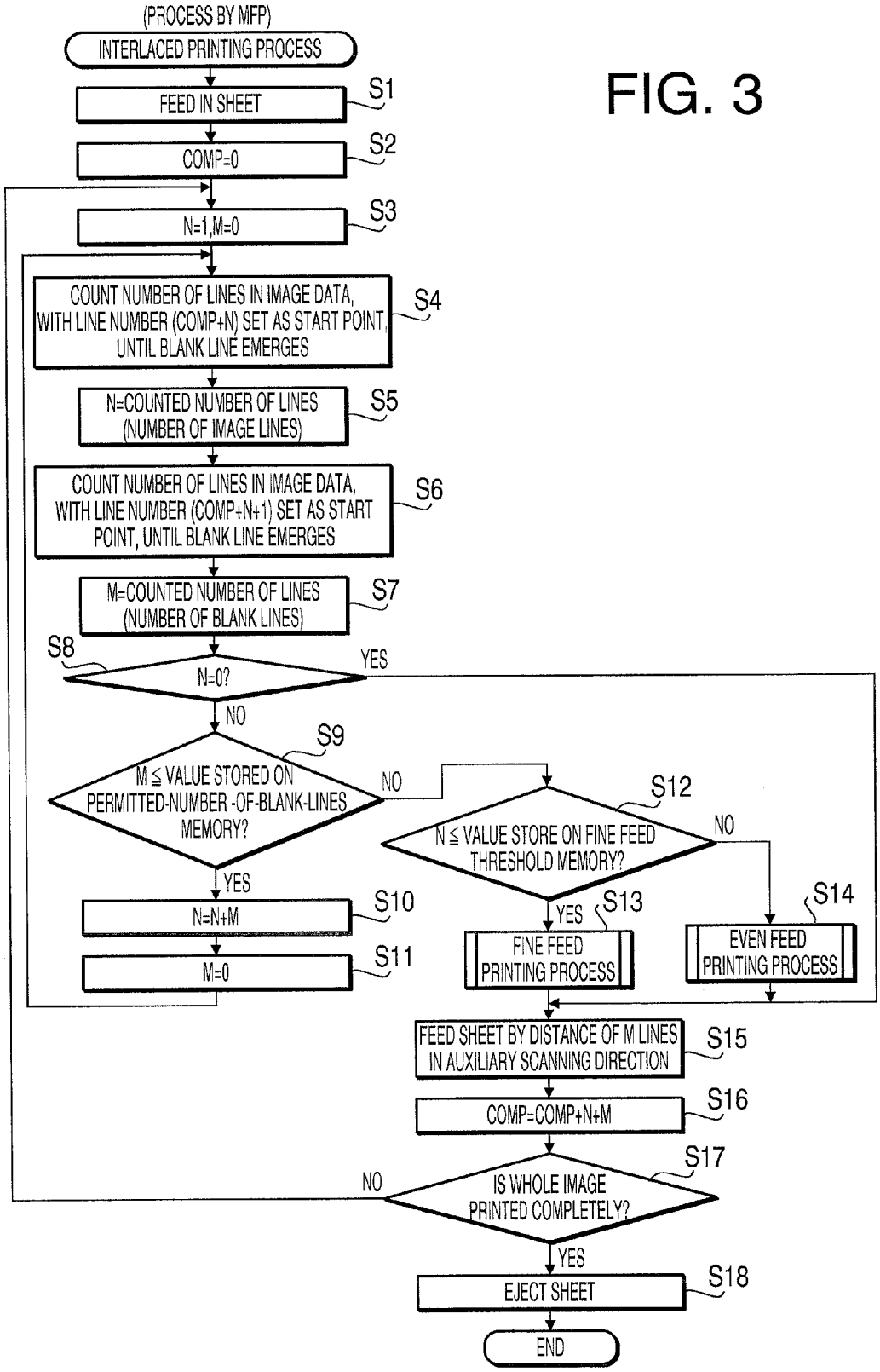
FIG. 3 is a flowchart of an interlaced printing process to be executed by the MFP in the embodiment according to one or more aspects of the present invention.

Next, referring to FIG. 3, an explanation will be given about an interlaced printing process to be executed by the CPU 88 of the MFP 10. The interlaced printing process is a process for, especially when a whole image is printed, printing each image group of the whole image in a selected one of the fine feed method and the even feed method depending on the vertical width (i.e., the width in the auxiliary scanning direction) of the image group to be printed. The interlaced printing process is, for instance, executed in response to a print request, for printing of an image, input directly by the user or through a personal computer.

In the interlaced printing process, the CPU 88 initially feeds in a sheet (S1), and subsequently, initializes a parameter COMP to zero (S2). Next, the CPU 88 initializes parameters N and M to one and zero, respectively (S3).

Although a detailed explanation of it will be given later, the parameter COMP is set with the maximum value among line numbers of lines completely printed. Namely, the completely printed lines are identified with line numbers from one to the parameter COMP. In addition, when an image group to be printed is extracted from the image data, the parameter N is set with the total number of lines included in the extracted image group, and the parameter M is set with the total number of successive blank lines following the extracted image group.

Subsequently, the CPU 88 counts the number of lines in the image data, with the line number indicated by (the parameter COMP+the parameter N) set as a start point, until a blank line emerges (S4). When reaching the final line of the image during the counting, the CPU 88 terminates the counting. Then, the CPU 88 sets the parameter N with the number of lines counted in S4 (S5). Thereby, the parameter N is set with the number of the image lines.

Next, the CPU 88 counts the number of lines in the image data, with the line number indicated by (the parameter COMP+the parameter N+1) set as a start point, until an image line emerges (S6). When reaching the final line of the image during the counting, the CPU 88 terminates the counting. Then, the CPU 88 sets the parameter M with the number of lines counted in S6 (S7). Thereby, the parameter M is set with the number of the image lines.

Then, the CPU 88 determines whether the parameter N is zero (S8). When the parameter N is zero (S8: Yes), the CPU 88 recognizes that there is no image line to be printed, and thus goes to S15 without executing the steps S9 to S14. Meanwhile, when the parameter N is equal to or more than one (S8: No), the CPU 88 determines whether the parameter M is equal to or less than the value stored on the permitted-number-of-blank-lines memory 89*a* (S9).

When the parameter M is equal to or less than the value stored on the permitted-number-of-blank-lines memory 89*a* (S9: Yes), the CPU 88 recognizes the blank lines of which the number has been counted in S6 as a part of the image group, and thus adds the parameter M to the parameter N (S10).

Then, the CPU 88 sets the parameter M to zero (S11), and goes back to S4 to repeat the steps S4 to S11. By repeating these steps, it is possible to extract the image group to be printed from the whole image. Moreover, it is possible to set the parameter N with the total number of lines included in the image group to be printed, and to set the parameter M with the total number of successive blank lines following the image group.

Meanwhile, when the parameter M is more than the value stored on the permitted-number-of-blank-lines memory 89*a* (S9: No), the CPU 88 recognizes that the image group to be printed is extracted (or the extraction is finished), and thus determines whether the parameter N is equal to or less than the value stored on the fine feed threshold memory 89*b* (S12).

When the parameter N is equal to or less than the value stored on the fine feed threshold memory 89*b* (S12: Yes), the CPU 88 recognizes that the vertical width (the width in the auxiliary scanning direction) of the image group to be printed is equal to or less than the nozzle width H of the print head HE, and thus executes the fine feed printing process (S13).

Although a detailed explanation of it will be given later (see FIG. 4A), the fine feed printing process is for printing the image group to be printed (of which the total number of image lines is N) on the sheet in the fine feed method (see FIG. 2A).

Meanwhile, when the parameter N is more than the value stored on the fine feed threshold memory 89*b* (S12: No), the CPU 88 recognizes that the vertical width (the width in the auxiliary scanning direction) of the image group to be printed is more than the nozzle width H of the print head HE, and thus executes the even feed printing process (S14).

Although a detailed explanation of it will be given later (see FIG. 4B), the even feed printing process is for printing the image group to be printed (of which the total number of image lines is N) on the sheet in the even feed method (see FIG. 2A).

After S13 or S14, the CPU 88 feeds the sheet by a distance of M lines in the auxiliary scanning direction (S15). Then, the CPU 88 adds the parameters N and M to the parameter COMP (S16). Thereafter, the CPU 88 determines whether the whole image is completely printed (S17). When the whole image is not completely printed (S17: No), the CPU 88 goes to S3 to repeat the steps S3 to S17. When the whole image is completely printed (S17: Yes), the CPU 88 ejects the sheet with the image printed thereon (S18). After that, the CPU 88 terminates the interlaced printing process.

In the embodiment, when an image group to be printed is extracted from the whole image, continuously emerging blank lines, of which the number is equal to or less than the value stored on the permitted-number-of-blank-lines memory 89*a*, are recognized as a part of the continuing image group.

Therefore, in the embodiment, the total number of image groups extracted is less than that in the case where emergence of at least one blank line is recognized as an end of an image group, and subsequently emerging image lines are identified as a different image group. Thus, in the embodiment, it is possible to reduce the number of printing operations (scanning operations).

Figure 5:
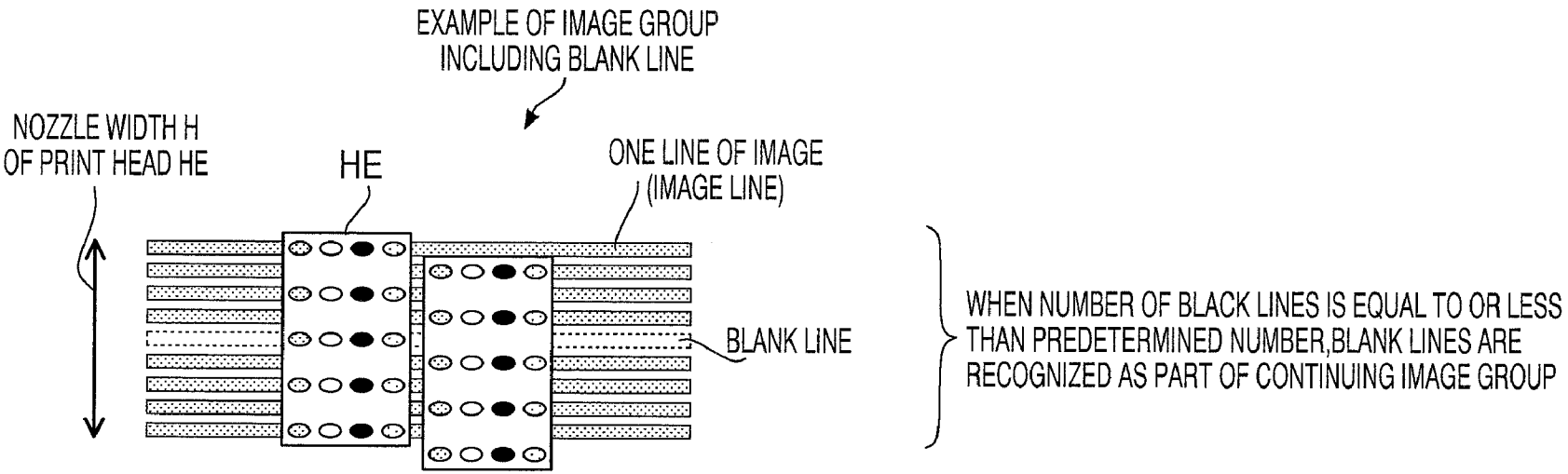
FIG. 5 is an illustration exemplifying an image group including a blank line in the embodiment according to one or more aspects of the present invention.

FIG. 5 exemplifies the above effect. The image group shown in FIG. 5 has continuously emerging blank line(s) of a number equal to or less than the value stored on the permitted-number-of-blank-lines memory 89*a*. Further, the vertical width (the width in the auxiliary scanning direction) of the image group is equal to or less than the nozzle width H of the print head HE. In this case, the image group shown in FIG. 5 is treated as a single image group, and completely printed by two scanning operations in the fine feed method.

On the contrary, in the case where emergence of at least one blank line is recognized as an end of an image group, and subsequently emerging image lines are identified as a different image group, the image group shown in FIG. 5 is treated as two different image groups. Therefore, a first image group is printed by two scanning operations in the fine feed method, and then a second image group is printed by two scanning operations in the fine feed method. Accordingly, four scanning operations are needed in total to completely print the image group shown in FIG. 5. The above explanation has been provided under an assumption that the fine feed method is applied. Nevertheless, even when the even feed method is applied, it is possible to reduce the number of scanning operations, in the same manner, due to a decreased number of image groups extracted.

As described above, in the embodiment, when an image group to be printed is extracted from the whole image, continuously emerging blank lines, of which the number is equal to or less than the value stored on the permitted-number-of-blank-lines memory 89*a*, are recognized as a part of the continuing image group. Therefore, the total number of image groups extracted in the embodiment is less than that in the case where emergence of at least one blank line is recognized as an end of an image group, and subsequently emerging image lines are identified as a different image group. Thus, in the embodiment, it is possible to reduce the number of printing operations (scanning operations).

Figure 4A:
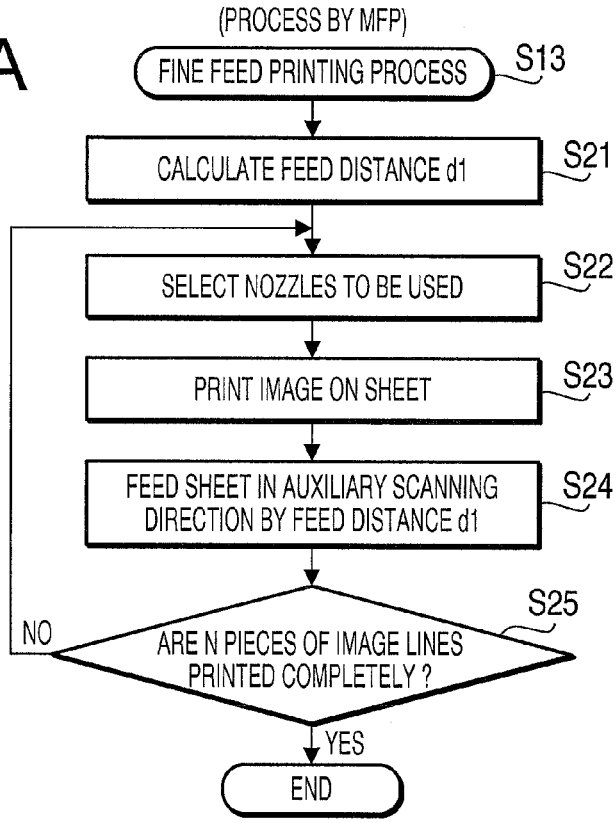
FIG. 4A is a flowchart of a fine feed printing process to be executed by the MFP in the embodiment according to one or more aspects of the present invention.

Next, referring to FIG. 4A, an explanation will be given about the fine feed printing process (S13) to be executed by the CPU 88 of the MFP 10.

The fine feed printing process is for printing the image group to be printed (of which the total number of image lines is N) on the sheet in the fine feed method (see FIG. 2A).

In the fine feed printing process, the CPU 88 first calculates the feed distance d1 (S21). As described above, in the embodiment, the feed distance d1 is determined according to the following expression:

$$d1\ [\text{inches}]=(MR\ [\text{lines/inch}]/R\ [\text{lines/inch}])\times(\text{a line of feed distance [inches]}).$$

It is noted that the above feed distance d1 is just an example, and may be set appropriately depending on the specification of the printer unit 11.

Next, the CPU 88 selects (determines) nozzles to be used from the nozzles of the print head HE (S22). Then, the CPU 88 causes each of the selected nozzles to discharge ink, and prints an image on the sheet (S23).

Subsequently, the CPU 88 feeds the sheet in the auxiliary scanning direction by the feed distance d1 (S24), and then determines whether N lines of images (i.e., N pieces of image lines) are completely printed (S25). When the N lines of images are not completely printed (S25: No), the CPU 88 goes back to S22 to repeat the steps S22 to S25. Meanwhile, when the N lines of images are completely printed (S25: Yes), the CPU 88 recognizes that the image group is completely printed, and then terminates the fine feed printing process.

Accordingly, the image group printed in the fine feed method can be printed by scanning operations less than those in the even feed method, and thus the throughput for printing the image group can be enhanced. Further, the vertical width of the image group printed in the fine feed printing method is shorter than the nozzle width H of the print head HE. Even though there is variation in the pitches or the ink discharging characteristics of the nozzles of the print head HE, the variation hardly emerges in a repeated manner within the vertical width of the image group printed in the fine feed printing process. Hence, even though the image group is printed in the fine feed printing process, it is possible to attain the same image quality as would be attained in the even feed printing process.

Figure 4B:
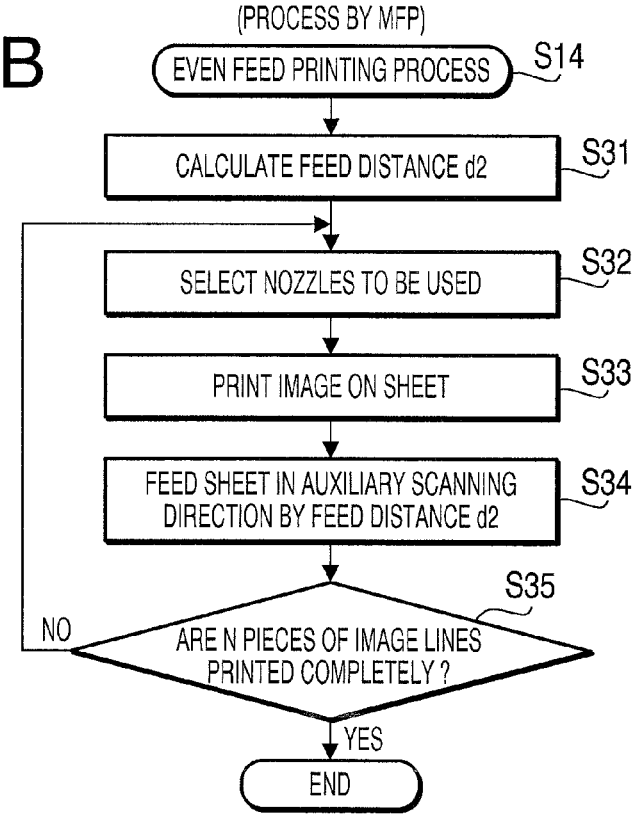
FIG. 4B is a flowchart of an even feed printing process to be executed by the MFP in the embodiment according to one or more aspects of the present invention.

Subsequently, with reference to FIG. 4B, an explanation will be given about the even feed printing process (S14) to be executed by the CPU 88 of the MFP 10. The even feed printing process is for printing the image group to be printed (of which the total number of image lines is N) on the sheet in the even feed method (see FIG. 2A).

In the even fed printing process, initially, the CPU 88 calculates the feed distance d2 (S31). As mentioned above, in the embodiment, the feed distance d2 is expressed as follows:

$$d2\ [\text{inches}]=(H\ [\text{inches}]\times MR\ [\text{lines/inch}]/K)\times(\text{a line of feed distance [inches]}).$$

It is noted that the above feed distance d2 is just an example, and may be set appropriately depending on the specification of the printer unit 11.

Next, the CPU 88 selects (determines) nozzles to be used from the nozzles of the print head HE (S32). Then, the CPU 88 causes each of the selected nozzles to discharge ink, and prints an image on the sheet (S33).

Subsequently, the CPU 88 feeds the sheet in the auxiliary scanning direction by the feed distance d2 (S34), and then determines whether N lines of images (i.e., N pieces of image lines) are completely printed (S35). When the N lines of images are not completely printed (S35: No), the CPU 88 goes back to S32 to repeat the steps S32 to S35. Meanwhile, when the N lines of images are completely printed (S35: Yes), the CPU 88 recognizes that the image group is completely printed, and then terminates the even feed printing process. Accordingly, even though there is variation in the pitches or the ink discharging characteristics of the nozzles of the print head HE, it is possible to disperse printed areas deteriorated due to the variation and obscure the deteriorated image quality. Thereby, it is possible to avoid a locally deteriorated image and thus obtain a uniformed and enhanced quality of whole image.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

An only exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

In the interlaced printing process (see FIG. 3) of the aforementioned embodiment, in the operation of extracting the image group to be printed from the whole image, when the number of continuously emerging blank lines is equal to or less than the value stored on the permitted-number-of-blank-lines memory 89*a*, the blank lines are recognized as (not a separator but) a part of the image group. Alternatively, however, when at least one blank line emerges, subsequently emerging image lines may be identified as a different image group. In this case, when an image group placed between at least one blank line and at least one different blank line has a length in the auxiliary scanning direction equal to or less than the nozzle width H of the print head HE, the image group may be printed in the fine feed method. Meanwhile, when the image group has a length in the auxiliary scanning direction more than the nozzle width H of the print head HE, the image group may be printed in the even feed method.

Figure 6:
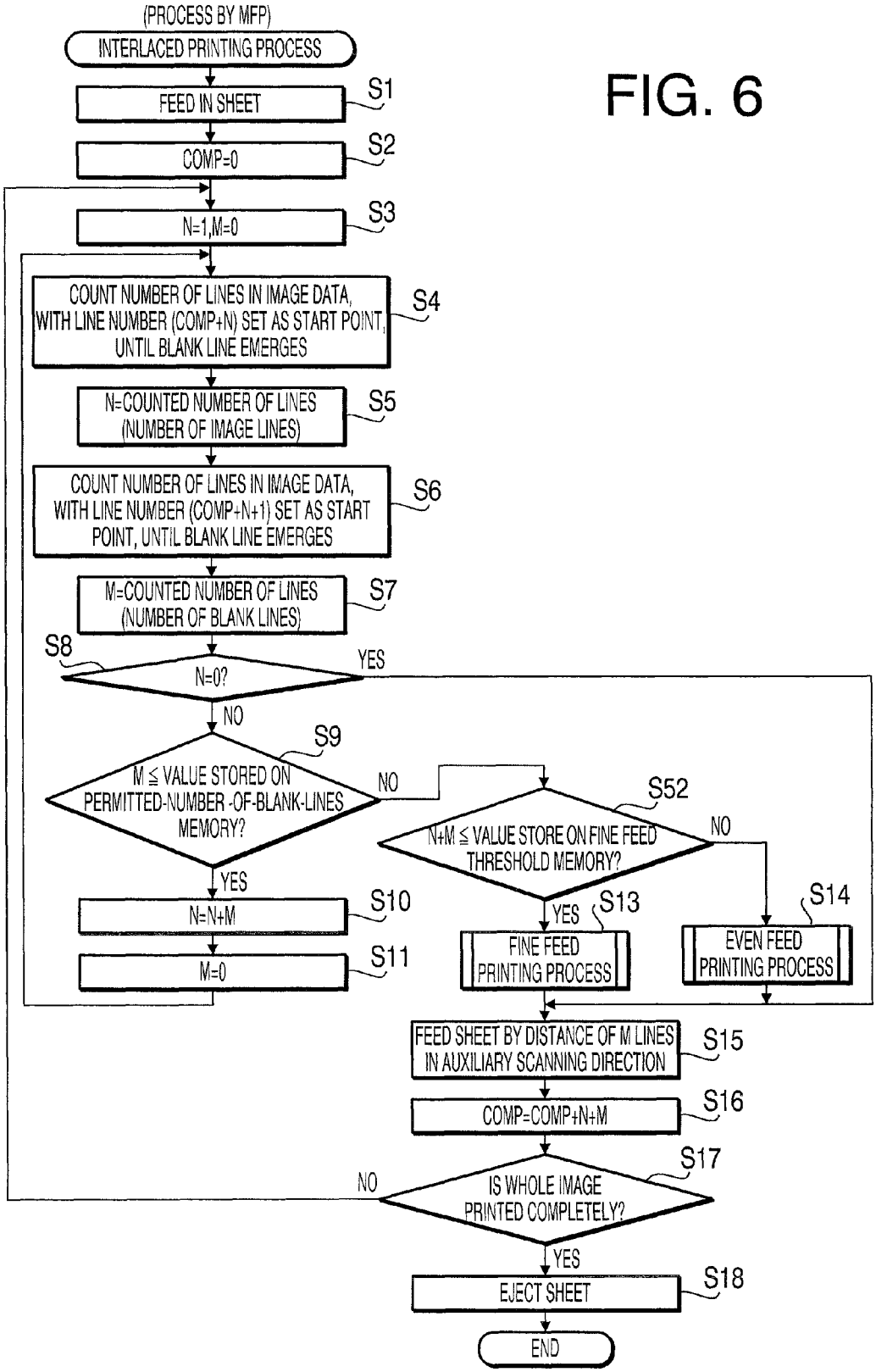
FIG. 6 is a flowchart of an interlaced printing process to be executed by an MFP in a modification according to one or more aspects of the present invention.

In the interlaced printing process (see FIG. 3) of the aforementioned embodiment, after the image group to be printed is extracted from the whole image, it is determined whether the total number of lines of the image group (i.e., the parameter N) is equal to or less than the value stored on the fine feed threshold memory 89*b*. Alternatively, however, it may be determined whether the sum of the total number of lines of the image group (i.e., the parameter N) and the total number of successive blank lines following the image group (i.e., the parameter M) is equal to or less than the value stored on the fine feed threshold memory 89*b* (see S52 in FIG. 6).

In the interlaced printing process (see FIG. 3) of the aforementioned embodiment, in the operation of extracting the image group to be printed from the whole image, counted are the total number of lines of the image group (i.e., the parameter N) and the total number of successive blank lines following the image group (i.e., the parameter M). Alternatively, however, instead of the total number of successive blank lines following the image group, the total number of successive blank lines preceding the image group may be counted and set as the parameter M. Furthermore, it may be determined whether the sum of the total number of lines of the image group (i.e., the parameter N) and the total number of successive blank lines preceding the image group (i.e., the parameter M) is equal to or less than the value stored on the fine feed threshold memory 89*b*.

In the aforementioned embodiment, the fine feed threshold memory 89*b* stores a value calculated according to the expression "nozzle width [inches]×the maximum image resolution MR [lines/inch]." However, the fine feed threshold memory 89*b* may store a value obtained by adding (the repeat number K−1) to the above value. For example, it is assumed that an image of a vertical width equal to the nozzle width H is printed, and the repeat number K is two. In this situation, after a first printing operation, the sheet is fed in the auxiliary scanning direction, and thereafter a second printing operation is performed. Accordingly, in the second printing operation, printing is permitted in a new additional area accompanying the feeding in the auxiliary scanning direction. Namely, when the repeat number K is two or more, and an image of a vertical width generally equal to the nozzle width H is printed, it is possible to print an image of an increased vertical width by (the repeat number K−1) lines without having to increase the number of printing operations. Thus, even though the image group to be printed has a vertical width more than the nozzle width H by (the repeat number K−1) lines, it is possible to apply the fine feed method and thereby reduce the number of printing operations (scanning operations).

In the aforementioned embodiment, the printer unit 11 is a carriage type printer configured to reciprocate the carriage (not shown) in the main scanning direction (the X-direction in FIG. 1). However, aspects of the present invention may be applied to a line type printer as well. Further, in the aforementioned embodiment, the printer unit 11 is configured with an inkjet printer. However, other types of printers may be employed, such as a thermal-transfer printer, a thermal printer, and a dot impact printer.

What is claimed is:

1. An image recording device comprising:

a feeder configured to feed a recording medium in a predetermined direction;

a recorder comprising a plurality of dot forming elements aligned in the predetermined direction at intervals of a predetermined pitch, the recorder being configured to record images by forming dots, with the dot forming elements, at intervals of a distance shorter than the predetermined pitch in the predetermined direction on the recording medium fed by the feeder;

a first identifying unit configured to identify, as an image group, at least one image to be recorded between blank areas in the predetermined direction;

a determining unit configured to determine whether a first whole length of the image group identified by the first identifying unit in the predetermined direction is equal to or less than a second whole length of the dot forming elements in the predetermined direction;

a first controller configured to, when the determining unit determines that the first whole length is not equal to or less than the second whole length, repeat a first feed control and a first record control so as to record the image group, the first controller controlling, in the first feed control, the feeder to feed the recording medium by a first feed distance more than the predetermined pitch, the first controller controlling, in the first record control, the recorder to record a part of the image group with dot forming elements selected such that any adjacent two dots of the image group in the predetermined direction are recorded with respective different dot forming elements; and a second controller configured to, when the determining unit determines that the first whole length is equal to or less than the second whole length, repeat a second feed control and a second record control so as to record the image group, the second controller controlling, in the second feed control, the feeder to feed the recording medium by a second feed distance equal to or less than the predetermined pitch, the second controller controlling, in the second record control, the recorder to record a part of the image group such that any adjacent two dots of the image group in the predetermined direction are permitted to be recorded with an identical dot forming element.

2. The image recording device according to claim 1, further comprising a second identifying unit configured to identify, as a valid blank area, a blank area extending longer than a predetermined length in the predetermined direction, wherein the first identifying unit is configured to identify, as the image group, at least one image to be recorded between an upstream valid blank area and a downstream valid blank area, which are identified by the second identifying unit, in the predetermined direction.

3. The image recording device according to claim 1, wherein the recording unit is configured to be reciprocated along a direction perpendicular to the predetermined direction and parallel to the recording medium.

4. The image recording device according to claim 1, wherein each of the dot forming elements comprises a nozzle configured to discharge ink onto the recording medium.

5. An image recording device comprising:

a feeder configured to feed a recording medium in a predetermined direction;

a recorder comprising a plurality of dot forming elements aligned in the predetermined direction at intervals of a predetermined pitch, the recorder being configured to record images by forming dots, with the dot forming elements, at intervals of a distance shorter than the predetermined pitch in the predetermined direction on the recording medium fed by the feeder;

a first identifying unit configured to identify, as an image group, at least one image to be recorded between blank areas in the predetermined direction;

a determining unit configured to determine whether a sum of a first whole length of the image group identified by the first identifying unit in the predetermined direction and a third whole length of a downstream one of the blank areas in the predetermined direction is equal to or less than a second whole length of the dot forming elements in the predetermined direction;

a first controller configured to, when the determining unit determines that the sum of the first whole length and the third whole length is not equal to or less than the second whole length, repeat a first feed control and a first record control so as to record the image group, the first controller controlling, in the first feed control, the feeder to feed the recording medium by a first feed distance more than the predetermined pitch, the first controller controlling, in the first record control, the recorder to record a part of the image group with dot forming elements selected such that any adjacent two dots of the image group in the predetermined direction are recorded with respective different dot forming elements; and a second controller configured to, when the determining unit determines that the sum of the first whole length and the third whole length is equal to or less than the second whole length, repeat a second feed control and a second record control so as to record the image group, the second controller controlling, in the second feed control, the feeder to feed the recording medium by a second feed distance equal to or less than the predetermined pitch, the second controller controlling, in the second record control, the recorder to record a part of the image group such that any adjacent two dots of the image group in the predetermined direction are permitted to be recorded with an identical dot forming element.

6. The image recording device according to claim 5, further comprising a second identifying unit configured to identify, as a valid blank area, a blank area extending longer than a predetermined length in the predetermined direction, wherein the first identifying unit is configured to identify, as the image group, at least one image to be recorded between an upstream valid blank area and a downstream valid blank area, which are identified by the second identifying unit, in the predetermined direction.

7. The image recording device according to claim 5, wherein the recording unit is configured to be reciprocated along a direction perpendicular to the predetermined direction and parallel to the recording medium.

8. The image recording device according to claim 5, wherein each of the dot forming elements comprises a nozzle configured to discharge ink onto the recording medium.

9. An image recording device comprising:

a feeder configured to feed a recording medium in a predetermined direction;

a recorder comprising a plurality of dot forming elements aligned in the predetermined direction at intervals of a predetermined pitch, the recorder being configured to record images by forming dots, with the dot forming elements, at intervals of a distance shorter than the predetermined pitch in the predetermined direction on the recording medium fed by the feeder;

a first identifying unit configured to identify, as an image group, at least one image to be recorded between blank areas in the predetermined direction;

a determining unit configured to determine whether a first whole length of the image group identified by the first identifying unit in the predetermined direction satisfies a condition with respect to a second whole length of the dot forming elements in the predetermined direction;

a first controller configured to, when the determining unit determines that the first whole length does not satisfy the condition with respect to the second whole length, repeat a first feed control and a first record control so as to record the image group, the first controller controlling, in the first feed control, the feeder to feed the recording medium by a first feed distance more than the predetermined pitch, the first controller controlling, in the first record control, the recorder to record a part of the image group with dot forming elements selected such that any adjacent two dots of the image group in the predetermined direction are recorded with respective different dot forming elements; and a second controller configured to, when the determining unit determines that the first whole length does not satisfy the condition with respect to the second whole length, repeat a second feed control and a second record control so as to record the image group, the second controller controlling, in the second feed control, the feeder to feed the recording medium by a second feed distance equal to or less than the predetermined pitch, the second controller controlling, in the second record control, the recorder to record a part of the image group such that any adjacent two dots of the image group in the predetermined direction are permitted to be recorded with an identical dot forming element.

* * * * *